US005964372A

United States Patent [19]

Dubois et al.

[11] Patent Number: 5,964,372

[45] Date of Patent: Oct. 12, 1999

[54] PLASTIC CONTAINER

[75] Inventors: Jean-Marc Dubois, Buttwil, Switzerland; Bernd Frommherz, Wutoschingen-Horheim, Germany; Thomas Jaussi, Spreitenbach; Boris Schwab, Baden, both of Switzerland

[73] Assignee: Georg Utz Holding AG, Bremgarten, Switzerland

[21] Appl. No.: 09/112,910

[22] Filed: Jul. 9, 1998

Related U.S. Application Data

[62] Division of application No. 08/607,834, Feb. 27, 1996, Pat. No. 5,862,935.

[30] Foreign Application Priority Data

| | | | |
|---|---|---|---|
| Feb. 28, 1995 | [CH] | Switzerland | 562/95 |
| Oct. 2, 1995 | [CH] | Switzerland | 2765/95 |

[51] Int. Cl.[6] ..... B65D 43/06

[52] U.S. Cl. ..... 220/642; 220/656; 220/657; 220/659; 220/771

[58] Field of Search ..... 220/797, 642, 220/656, 657, 659, 281, 771

[56] References Cited

U.S. PATENT DOCUMENTS

| | | | |
|---|---|---|---|
| 584,660 | 6/1897 | Arnot | 220/797 |
| 828,144 | 8/1906 | Snigo | 220/656 |
| 3,566,946 | 3/1971 | MacDonald | 220/659 |
| 3,840,152 | 10/1974 | Hodge . | |
| 4,014,452 | 3/1977 | Galer | 220/659 |
| 4,022,352 | 5/1977 | Pehr | 220/281 |
| 4,048,766 | 9/1977 | Dantzer et al. | 220/659 |
| 4,228,916 | 10/1980 | Weingardt | 220/642 |
| 4,293,073 | 10/1981 | Yates, Jr. | 220/659 |
| 4,520,943 | 6/1985 | Nielsen | 220/281 |
| 4,671,423 | 6/1987 | Murphy | 220/797 |
| 4,905,861 | 3/1990 | Boxall et al. | 220/284 |
| 5,050,762 | 9/1991 | Giorgi | 220/281 |
| 5,346,069 | 9/1994 | Intini . | |
| 5,425,469 | 6/1995 | Freedland | 220/797 |

FOREIGN PATENT DOCUMENTS

| | | |
|---|---|---|
| 0168877 | 1/1986 | European Pat. Off. . |
| 602536A2 | 6/1994 | European Pat. Off. . |
| 2185546 | 8/1972 | France . |
| 2565205 | 5/1985 | France . |
| 2700524 | 7/1994 | France . |

*Primary Examiner*—Joseph M. Moy
*Attorney, Agent, or Firm*—Ladas & Parry

[57] ABSTRACT

The container includes a lower part and a lid. The lower part is of a single wall structure and is reinforced at its upper edge area by a reinforcing wall. The lower end of the reinforcing wall is curved inwards and extends into the side wall. Thus, an edge at the lower end of the edge area is prevented. The upper edges of the lid are also rounded and run smoothly into the reinforcing wall. The lid includes ribs which, when the lid is placed on the lower part, come to lie onto corresponding ribs of the lower part. The lid is connected to the lower part by a snapping mechanism. The lid includes an opening, into which a ledge of the snapping mechanism can be snapped in. This ledge is accessible through this opening to release the ledge to disengage the opening.

15 Claims, 7 Drawing Sheets

PLASTIC CONTAINER

This application is a divisional of Ser. No. 08/607,834 filed Feb. 27, 1996 now U.S. Pat. No. 5,862,935.

BACKGROUND OF THE INVENTION

1. Field of the Invention

The present invention relates to a plastic container having a lower part and a lid, which lower part includes a single-ply bottom and single-ply side walls and a reinforcing wall, which single-ply side walls have an upper peripheral end area, and which reinforcing wall extends along the upper peripheral end area, whereby a peripheral double wall edge area of the lower part is formed; which lid has an outer circumferential area via which it rests on said peripheral double wall edge area of the lower part. It further relates to a container having a lower part and a lid, which lower part includes bottom and side walls and a reinforcing wall, which side walls have an upper peripheral end area and which reinforcing wall extends along the upper peripheral end area, and having at least one snapping mechanism for a locking of the lid to the lower part, which snapping mechanism includes at least a first and a second member, which members are movable at least between a closed position and a release position, and in the closed position are snapped into each other and counteract an opening of the lid, and are adapted to be operated into a release position by a deformation thereof such to allow an opening of the lid.

2. Description of the Prior Art

Such plastic containers are suitable for a storing of various articles. When such containers are used for a transporting of such articles, problems can occur specifically if the container is transported, sorted and handled together with other commodities. If for instance plastic containers are simultaneously transported with containers made of cardboard, the cardboard containers may be damaged.

Furthermore, such plastic containers are not ideally suitable for a handling and sorting in plants that are designed for handling cardboard boxes. The plastic containers jam quite often in such plants. This can lead to a blocking and to damages.

Furthermore, high demands are made regarding the stability of such containers. Specifically the lid should lend itself to be securely mounted to the lower part of the container, i.e. to the body, such that it cannot be opened also in case of a careless handling. Thus, conventional intrinsic solutions, for instance based on spring steel clamps, have been selected for a mounting of the lid, which clamps have, however, been difficult to operate and/or expensive.

Hence, it is a general object to provide a plastic container in which its reinforcing wall is curved inwards towards its side walls along at least a part of its periphery of the edge area.

It has been recognized that the design of the peripheral area or circumferential area, respectively, of the container is quite important for preventing the above mentioned problems. By a curving or bending, respectively, the lower end of the reinforcing wall an edge or rib in this portion of the edge area can be done without in comparison with known solutions. This decreases the danger of a damaging of other wares and the risk of a jamming or hooking.

A further object is to provide a container in which the reinforcing wall is curved at its lower end and ends into the corresponding side wall. This leads to a reinforcing of the peripheral area and discontinuities in the outer wall are avoided.

Yet a further object is to provide a container which includes first rib members extending between the side wall and the reinforcing wall, and second rib members located along the outer area of the lid. These ribs act as supports for the lid in that the ribs of the lid rest on corresponding ribs of the lower part. Such a supporting on relatively short ribs lends itself to a production at substantially less costs in comparison with a supporting along the long edge of the side or reinforcing wall.

A further object is to provide a container in which the supporting rib members of the lid extend obliquely relative to the supporting lid members of the bottom part such that a secure supporting is obtained.

A further object is to provide a container in which the lid is curved downwards at its outer circumferential area. Thus, it forms the curved or round, respectively, upper edges of the container. Preferably, the lid extends via a small air gap without an edge or change of direction, respectively, into the reinforcing wall.

Still a further object is to provide a container in which a peripherally extending sealing member is arranged between the upper edge of the side walls and the lid, such that the container meets high demands regarding its sealing. If the lid rests simultaneously onto the ribs mentioned above, the sealing member is not subjected to overly large forces when stacking the containers.

Still a further object is to provide a container which includes elastic arresting tongues forming arresting members for mounting the lid to the lower part. They are mounted, for instance, to an edge area of the lower part and snap into the lid. In order to release the connection, the tongues must be pressed inwards. To this end, actuation openings are foreseen in the lid or in the reinforcing wall of the peripheral area. Each actuation opening is substantially smaller than the tongue located thereunder and is located somewhat above the tongue in a laterally centred manner. By this central locating of the actuation opening over the tongue, it is ensured that a central force is exerted when actuating the tongue. The actuation opening acts, furthermore, as safety shield which prevents an unintentional opening of the container.

Yet a further object is to provide a container which is nestable without its lid and can be stacked when the lid is placed thereupon.

Still a further object is to provide a container in which at least one handle opening is located in its peripheral area.

It is a further object of the present invention to provide a plastic container having a lower part and a lid, and which has at least one snapping mechanism for a locking of the lid to the lower part, which snapping mechanism includes at least a first and a second member, which members are movable at least between a closed position and a release position, and are adapted, furthermore, to move from the closed position into a securing position upon an acting of a sufficient opening force thereupon, in which securing position they form a form-locked interconnection counteracting an opening force. Thus, when the lid of such a container is subjected to an opening force without that the members of the snapping mechanism have been previously brought into an open position, they move into a securing position in which they form a form-locked interconnection counteracting any opening force. It is not possible that the interconnection of these members could be released without an irreversible damaging of these members.

Thus, a further object is to provide a container in which the locking members are not elastically deformed in their closed position. Such is of great advantage because locking members made of a plastic material are inclined to creep when subjected to a force.

Yet a further object is to provide a plastic container, in which at least one first member includes a ledge and one second member includes an abutment surface, whereby the ledge contacts the abutment surface in the closed position of the snapping mechanism. This is not necessarily to be understood as a permanent contact between ledge and abutment surface, the geometry can be selected also so that the ledge contacts the abutment surface merely upon an exertion of a small opening force.

A further object is to provide a plastic container in which in order to open the lid the ledge must be urged away from the abutment surface in a first direction, and in the case of a forceful opening force, according to which the forces act from a different connection, the ledge is urged in a second direction relative to the abutment surface. The members of the snapping mechanism can thereby be shaped in such a manner that a urging of the ledge in the mentioned second direction leads, for instance, to one snapping member to be placed in a hook-like manner over the abutment surface.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENT

Figure 1:
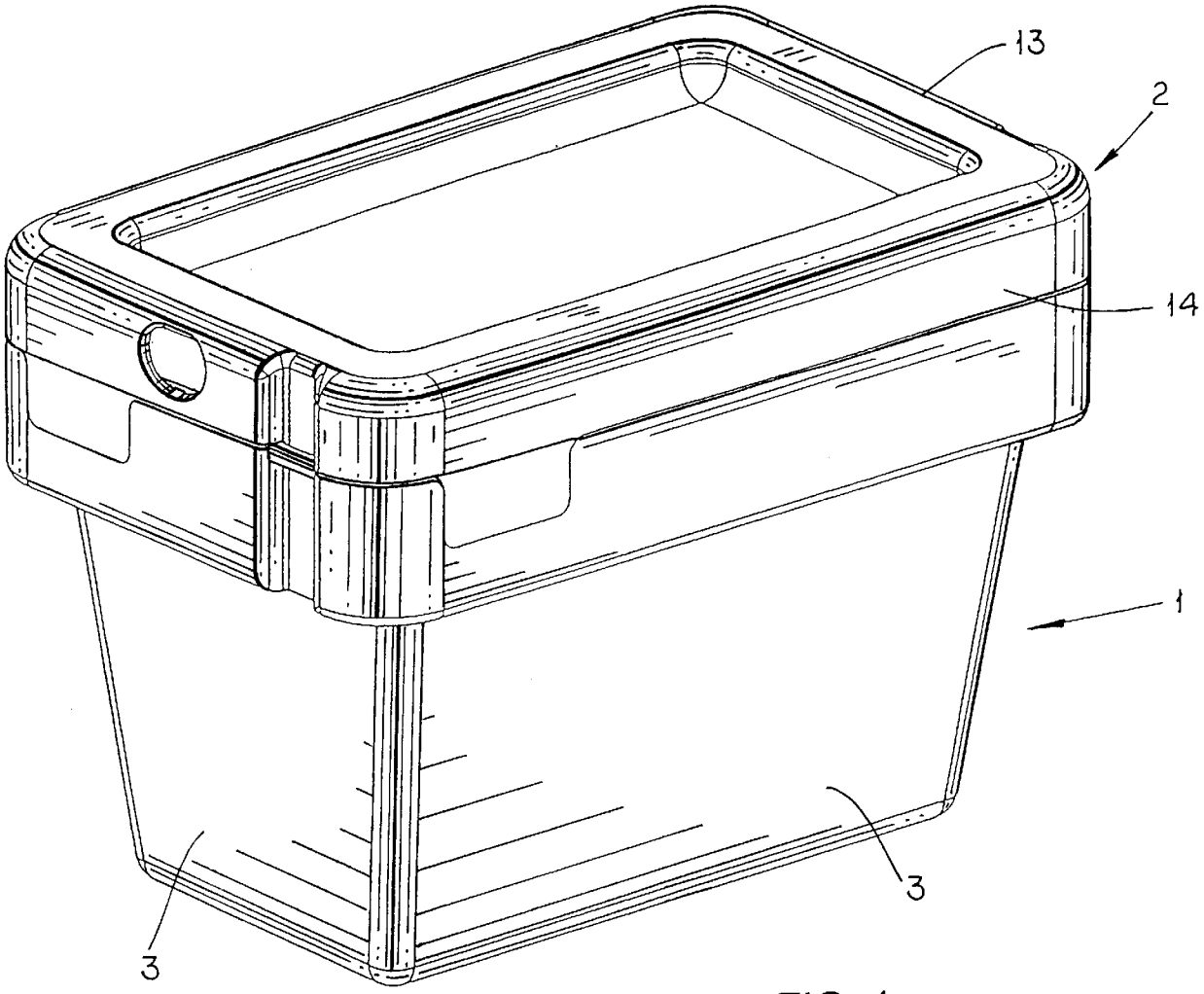
FIG. 1 is a view of a first embodiment of a container structured in accordance with the invention, in its closed state.
Figure 2:
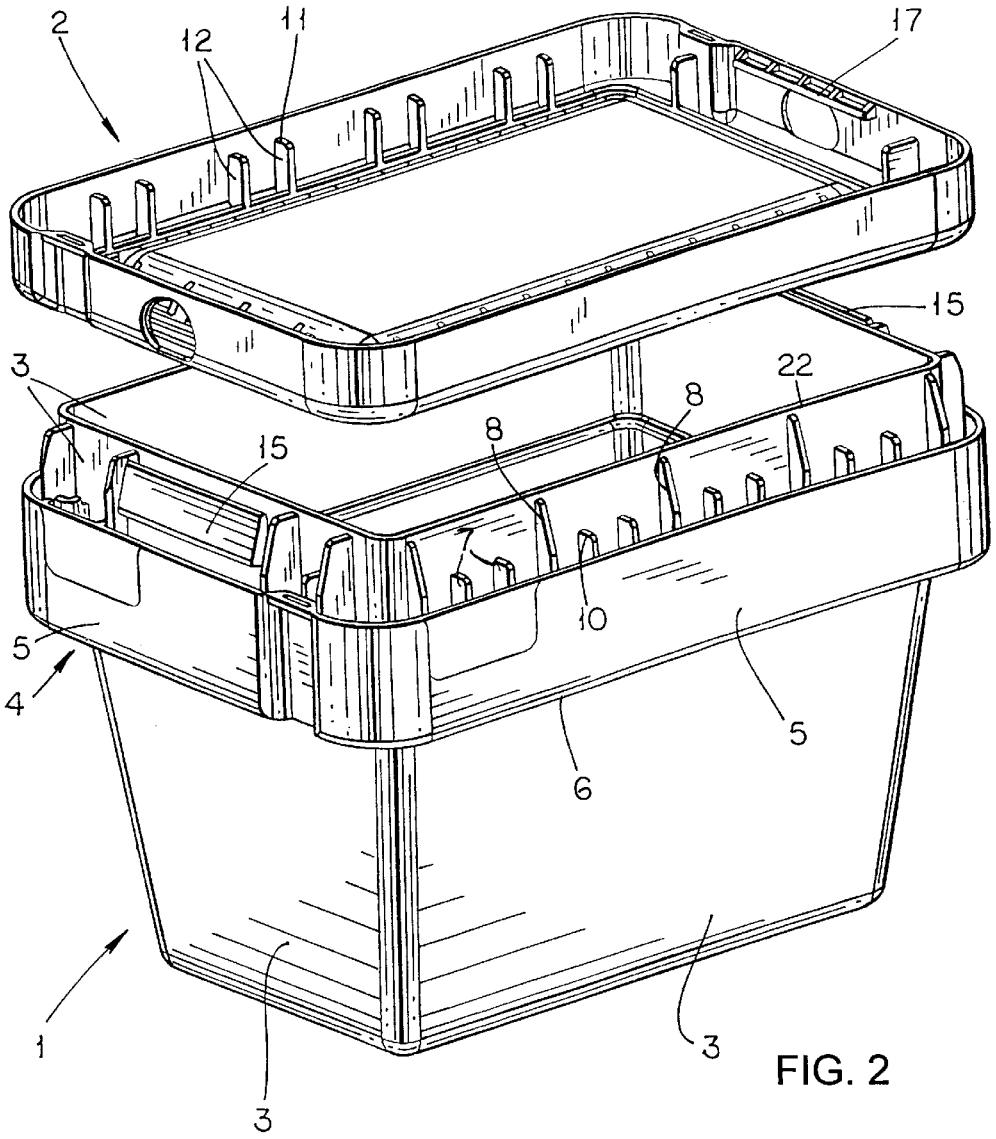
FIG. 2 shows the container of FIG. 1, whereby the lid is lifted off and turned upside down.

The general structure of a first preferred embodiment of the container is illustrated in FIGS. 1 and 2. It is thereby to be noted that the lid in FIG. 2 is shown turned upside down.

The container consists of two parts and includes a lower part 1 and a lid 2. The lower part 1 includes a bottom wall and four side walls 3, which are of a single-ply design and feature a substantially constant thickness. The side walls 3 converge somewhat downwards. The vertical edges between the side walls 3 and the horizontal edges between the side walls 3 and the bottom wall are rounded, such as is the case at all other outer edges of the container.

At its upper end, the lower part 1 forms a peripherally extending edge area 4. This edge area is of a double-wall design and includes as inner wall the respective side walls 3, and as outer wall a reinforcing wall 5. The side walls 3 and the reinforcing wall 5 extend in the edge area substantially vertically and parallel. The reinforcing area 4 reinforces the entire container and ensures its keeping its shape.

At its lower end 6, the reinforcing wall 5 is curved inwards and extends into the respective side wall 3. This is illustrated specifically also in FIG. 6.

As can be clearly seen in FIG. 1, the lid 2 is curved or round, respectively, at its outer circumferential area and passes into a vertical wall section 14. This wall section 14 ends above the reinforcing wall 5 of the lower part 1, whereby an air gap of a height of about 1 mm is formed between the vertical wall section 14 and the reinforcing wall 5.

Short and long ribs 7 and 8, respectively, extend between the side walls 3 and the reinforcing wall 5. These ribs stand vertically upright and form a reinforcing of the edge area. The long ribs 8 converge towards the top and form lateral guides when the lid is set onto the lower part. The short ribs 7 have horizontal upper edges and form a support for the lower edges 11 of corresponding ribs 12 of the lid 2.

In order to ensure a safe supporting, ribs 7 and 12 do not extend exactly parallel to each other. This can be specifically seen in FIG. 3, which illustrates a top view onto the edge area of the container. The parts of the lid are thereby designed in broken lines. Clearly recognizable is here the angle between the ribs 7 and 12. By this angle it can be avoided that the ribs 12 come to lie, e.g. due to a deforming of the lid, laterally at the side of the ribs 7. Thus, a safe, clearly defined support is produced which is in the position to take up also large stacking forces.

Figure 3:
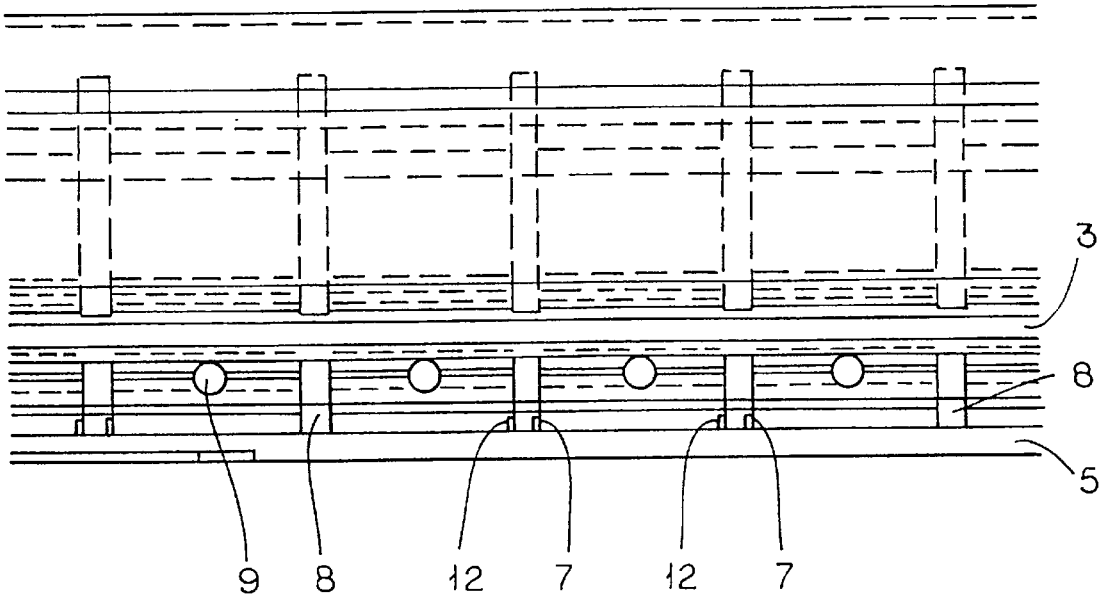
FIG. 3 shows a top view of a part of the peripheral area, whereby parts of the lid are drawn with broken lines.

Furthermore, openings 9 are illustrated in FIG. 3, which are arranged at uniform distances at the lower, horizontally extending end area 6 of the reinforcing wall 5. These openings prevent an accumulating of water at the edge area 4.

Figure 4:
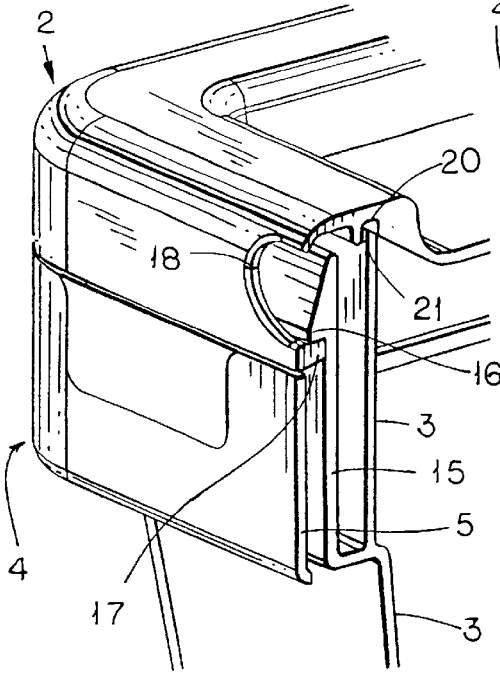
FIG. 4 shows a section through the edge of the container in the area of its closure members.

In order to mount the lid 2 onto the lower part 1, an arresting tongue 15, shaped as snapping member, is formed on each narrow end of the container. The arrangement and function of these tongues can best be seen in FIG. 4.

Each tongue 15 is connected at its lower end to the side wall 3 and extends vertically upwards. At its upper end it is equipped with a projection 16 with a ramping surface which snaps into a projection 17 of the lid 2. In order to release this connection, the tongue must be pressed inwards against its spring force. To this end, an actuation opening 18 is foreseen in the lid. It is located laterally centred over the upper end of the tongue 15 and ensures that the pressing force is always exerted centrally onto the tongue 15. The actuation opening 18 acts, furthermore, as protecting shield and prevents that the tongue can be accidentially pressed inwards.

The container as designed in FIGS. 1 to 3 is splash-proof. To this end, an elastic sealing ring 20 (FIG. 4) is foreseen between the upper edge 22 (FIG. 2) of the side wall 3 and the lid 1. This sealing ring is located in a groove 21 of the lid and extends, when the lid is placed onto the lower part, along the entire upper edge 22 of the side wall 3. Accordingly, the inner space of the container is sealed at all places.

It is hereby to be noted that the sealing ring 20 does not act as support for the lid—for this purpose the ribs 7 and 11 are foreseen. This prevents the sealing ring 20 from being additionally compressed when the containers are stacked.

Figure 5:
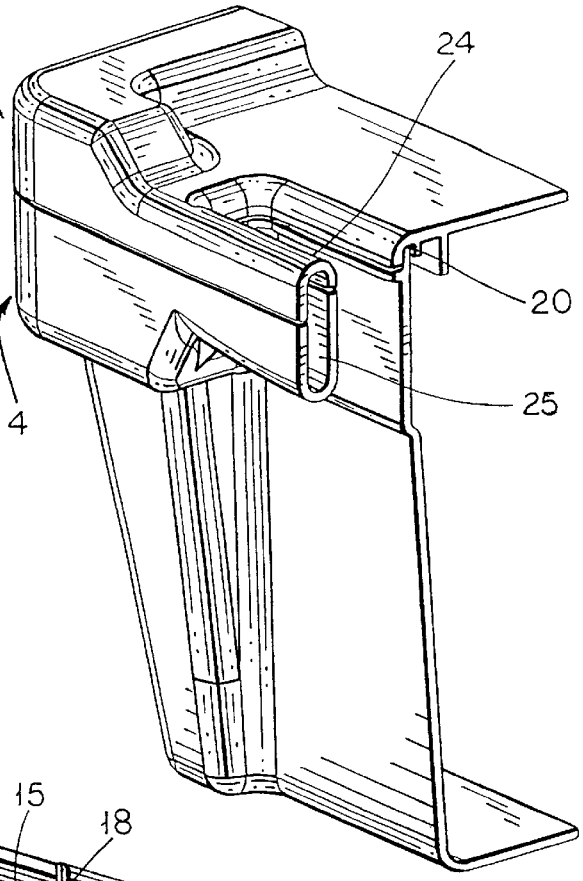
FIG. 5 is a view of a second embodiment of the container having a handlehold.

FIG. 5 illustrates a partial view of an alternative embodiment of the container structured in accordance with the invention. At both narrow ends of this container a handhold opening 24 is foreseen. This opening extends through the edge area 4 of the lower part 1 and the lid 2, whereby corresponding openings are formed in the edge area 4 and in the lid 2. The edge area and the lid thereby form a rounded grip 25. The sealing ring 20 extends inside of the handholding opening 24 such that a sealing of the inner space of the container remains ensured.

At the embodiment according to FIG. 5 the arresting tongues are not located at the narrow side but rather at the broad sides of the container. Because the container of this embodiment is larger than the one according to FIG. 1, two arresting tongues 15 each are foreseen at each longitudinal side. One of these tongues is shown in part in FIG. 6.

Figure 6:
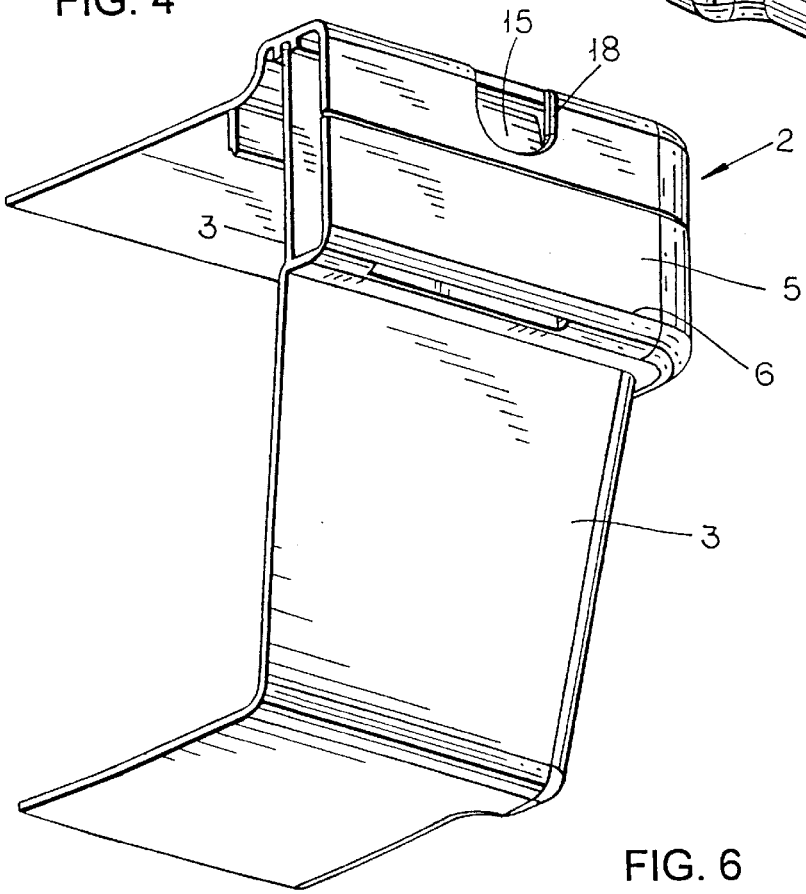
FIG. 6 is a view of the locking members of the embodiment according to FIG. 5.

As can be seen from FIG. 6, the reinforcing wall 5 is also rounded inwards at its lower end 6 and extends into the corresponding side wall 3. This is the case substantially along the entire circumference of the container, with the exception of the handhold area.

The container structured in accordance with the invention is designed in such a manner that it is nestable without lid and stackable with the lid. This is illustrated in FIGS. 7 and 8.

Figure 7:
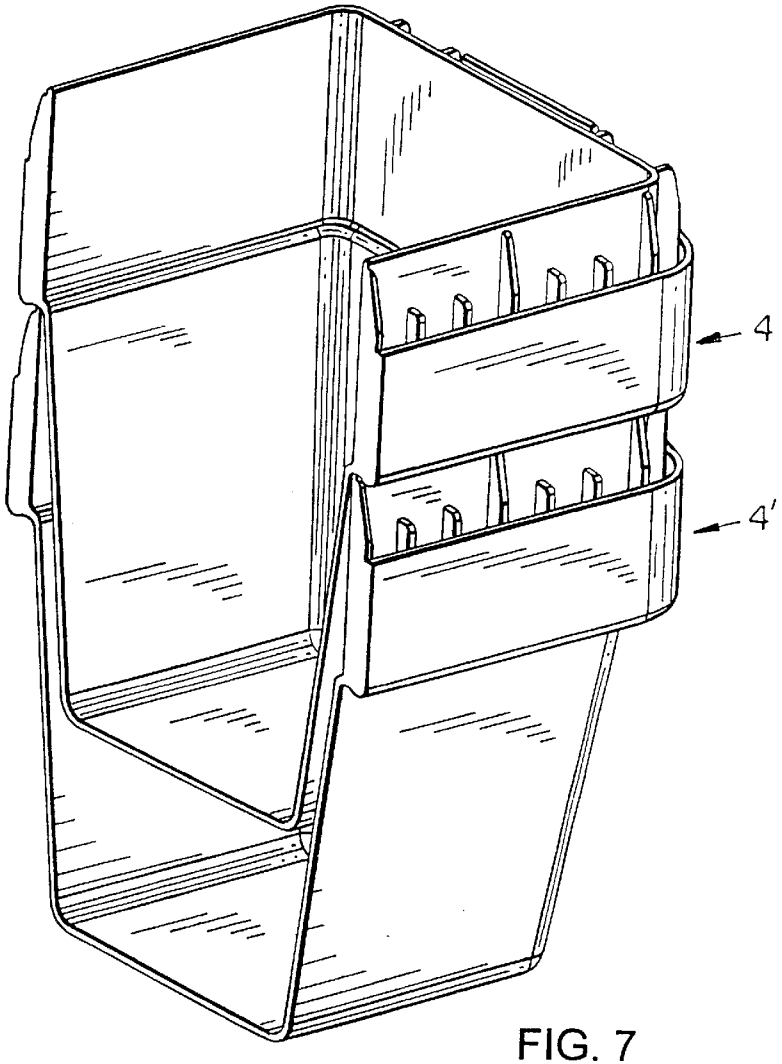
FIG. 7 is a view of nested containers of FIG. 1.

At the nested stated illustrated in FIG. 7, the lower end of the edge area 4 of a container lies on the upper end of the edge area 4' of the next lower container. To this end, the lower part is reduced somewhat below its edge area.

Figure 8:
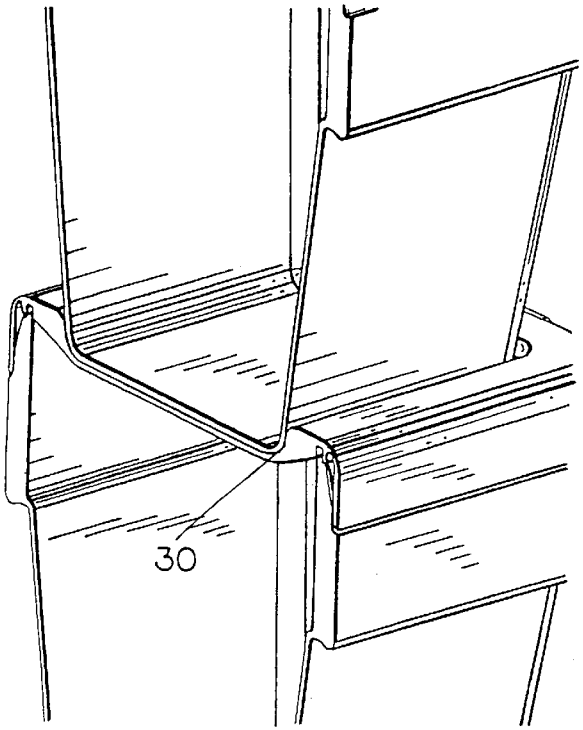
FIG. 8 is a view of stacked containers according to FIG. 1.
Figure 9:
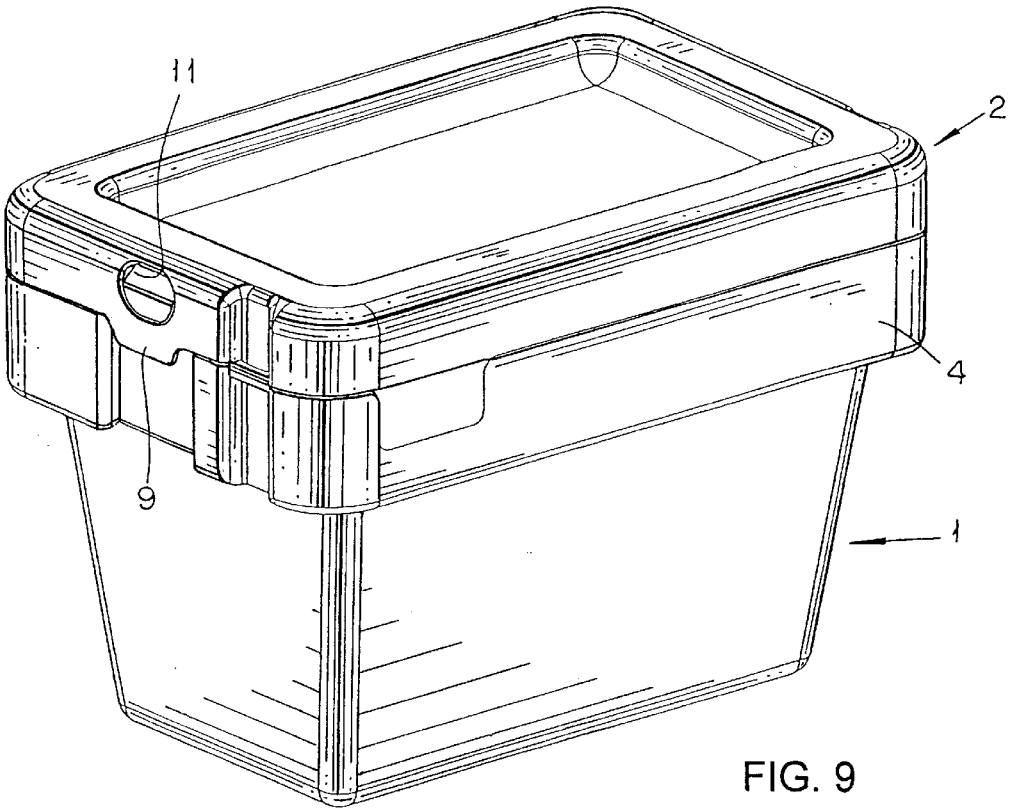
FIG. 9 is a view of a further embodiment of the container structured in accordance with the invention.

At the stacking of the containers illustrated in FIG. 8, each container stand in a recess 30 of the lid of the following lower container, whereby the recess 30 is designed to conform to the shape of the bottom of the container. Thus, a safe, aligned stacking is ensured.

The container structured in accordance with the invention is suitable to be produced by injection-molding.

Figure 10:
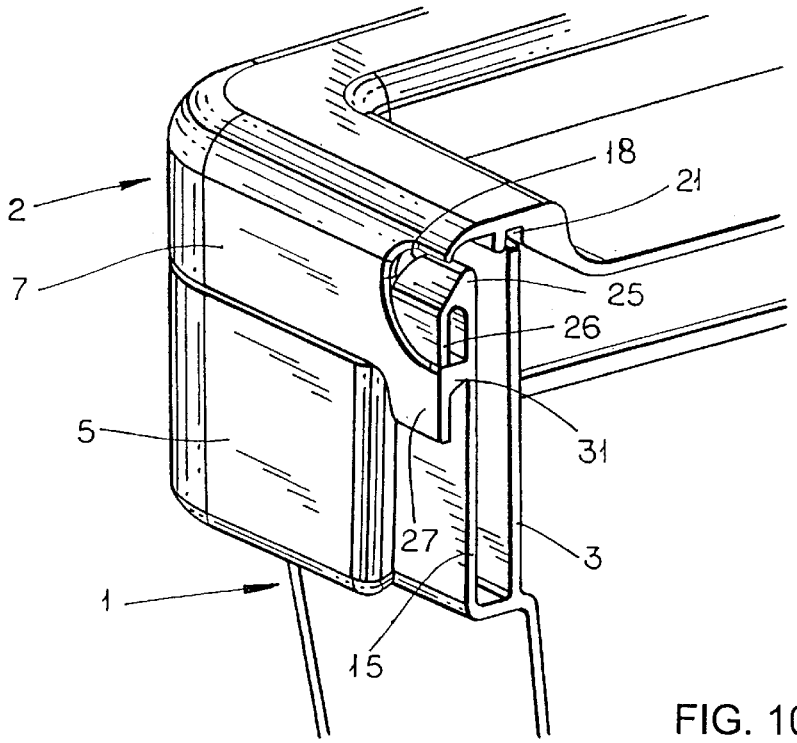
FIG. 10 is a view of a section through part of the container illustrated in FIG. 9.

Attention is now drawn to FIG. 10, illustrating the basic design of a yet further embodiment of the container in accordance with the invention. The embodiment illustrated is a plastic container produced by an injection-molding process having a volume of about 10 liters.

Figure 11:
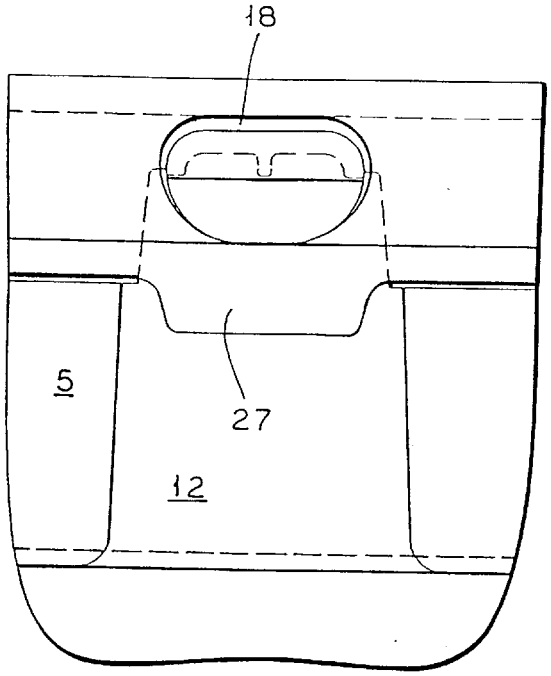
FIG. 11 is a front view of a snapping mechanism.
Figure 12:
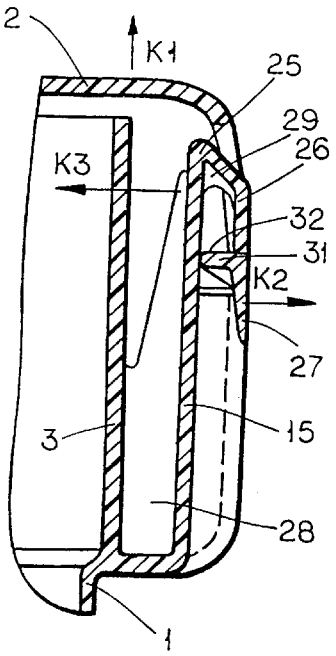
FIG. 12 illustrates a vertical section through the snapping mechanism.
Figure 13:
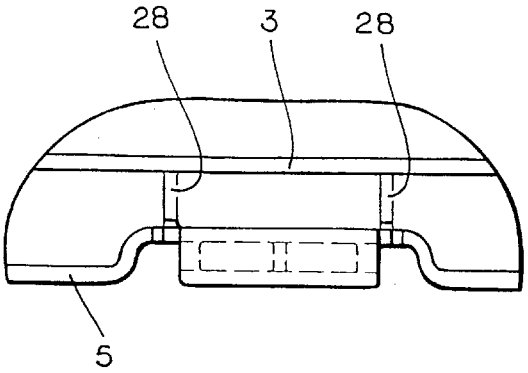
FIG. 13 is a top view of the lower part of the container without lid and at the area of the snapping mechanism.
Figure 14:
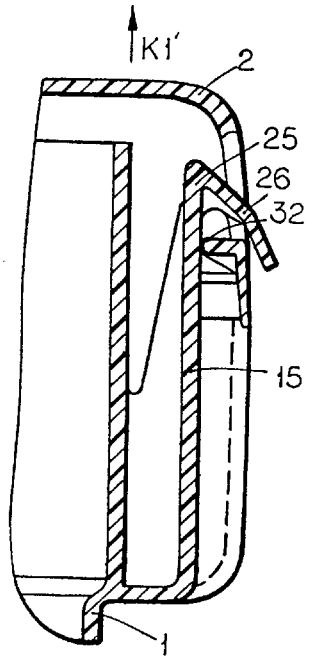
FIG. 14 is a vertical section through the snapping mechanism in its securing position.

The container is structured of two parts, the lower part 1 and the lid 2. The upper edge area 4 of the lower part 1 is reinforced forming a double wall. As illustrated in FIG. 11, the side wall 3 of the lower part 1 projects into a circumferential groove 21 of the lid 2 and prevents a lateral shifting of the lid 2 relative to the lower part 1. The reinforcing wall 5 of the lower part 1 is aligned with the vertical wall section 14 of the lid 2.

The lid 2 is to be releasably mounted to the lower part 1 as shown in this embodiment by two snapping mechanisms located on opposite sides of the container, of which snapping mechanisms only one is illustrated in FIGS. 10 and 11. Depending from size and shape of the container, the number of snapping mechanisms can obviously also be larger or smaller.

The design of the snapping mechanism will now be explained based on FIGS. 11 to 14.

The snapping mechanism consists of two closure members, of which one is formed onto the lid 2 and the other one onto the lower part 1. At the lower part 1 the closure member includes a tongue 15, 25, 26, at the lid an actuation opening 18 and a grip 27.

The tongue 15 is formed in a recessed area of the vertical reinforcing wall 5 of the side wall 3. It is reinforced by two ribs 28. At the lower area of the tongue 15 these ribs extend up to the side wall 3 and converge in an upward direction. At its upper end the tongue 15 is followed by a head section 25, which forms a curvilinear transition to a ledge 26. The head 25 is reinforced at its inner side by three ribs 29.

The ledge 26 is flush with the outer side of the edge area of the lid. This avoids an accidental operating or a catching at other objects.

The bottom end of the ledge 26 contacts the lower edge of the opening 18. This edge forms together with a ledge 31 an abutment surface 32.

The snapping mechanism is illustrated in FIGS. 10 to 14 in its locking state. In this position it counteracts an opening of the lid. If a pulling force K1 which is not too large is exerted onto the lid 2 (see FIG. 13), this force will be transmitted via the abutment surface 32 onto the tongue 15 and accordingly to the lower part 1.

In the locking position all parts of the snapping mechanism are relaxed, i.e. they are not subject to an elastic deformation. This prevents a creeping of the plastic material and a permanent deformation of the parts involved.

In order to open the lid 2, the snapping mechanism must be brought into an open position. To this end, the operator places e.g. his index finger behind the grip 27 and presses with the thumb onto the ledge 26. Thus, the operator exerts lateral forces K2 and K3. The edge area of the lid 2 will deform thereby elastically outwards. At the same time an elastic deforming of the ledge 26, of the head section 25 and of the tongue 15 in an inward direction is caused. The tongue 15 thereby moves from the abutment surface 32 inwards, such that the lid is released and may be opened.

In order to close the lid 2, it is simply set onto the lower part 1. The grip 27 end the ledge 31 urge thereby the chamfered head section 25 inwards. As soon as the ledge has reached the height of the opening 18, the head moves due to its spring action again outwards into its locking position.

If the snapping mechanism is in its locking position and an extremely large pulling force K1' is exerted onto the lid, the snapping mechanism is brought into a securing position, which is illustrated in FIG. 15. The head section 25 and the ledge 26 are thereby deformed, and the ledge 26 slides towards the outside of the abutment surface 32. The abutment surface is lifted somewhat and withheld in a hook-like manner by the head section 25. By means of this, a further upward movement of the lid 2 is prevented. The lid 2 could be lifted still further only at a considerable deforming or even destruction of the snapping mechanism.

In order to ensure that the ledge 26 moves in the case of a larger force K1' automatically towards the outside, the illustrated embodiment includes an abutment surface 32 which is somewhat chamfered or slanted out-wards. Additionally, the ledge is positioned already in its normal locking position close to the outer edge of the abutment surface 32. The desired deformation is thereby supported further in that the curved head section 25 is positively widened somewhat by the force K1' and is bent somewhat inwards such that the ledge 26 attains an outward-directed position. The tongue 15 is, on the other hand, designed somewhat stiffer such that the head area 25 and the ledge 26 cannot pivot as one part inwards. These various measures complement each other ideally in the illustrated embodiment but can also be applied individually in order to cause the ledge 26 to slip upon exertion of a large force K1' forward of the abutment surface 32.

The embodiment of the invention illustrated in the figures can be quite easily produced by an injection-molding. Therefore, the tongue 15 is formed as part of the outer reinforcing wall 5, such that the area under the head section 25 is easily accessible and can be taken out of the form in one production step. The two closure members are integrally formed onto the lower part 1 and the lid 2, respectively, and do not need any further production steps for their production.

Due to the here described design, the container is quite stable. Even when it falls from a larger height level onto the ground, the lid will not get detached. Lateral forces acting onto the lid are transmitted by the groove 21 and suitable reinforcing ribs, respectively, onto the lower part 1, and pulling forces are taken safely by the snapping mechanism.

While there are shown and described preferred embodiments of the invention, it is to be distinctly understood that the invention is not limited thereto, but may be otherwise variously embodied and practised within the scope of the following claims.

We claim:

1. A plastic container comprising:

a lower part including a single-ply bottom and single-ply side walls and a reinforcing wall, said single-ply side walls having an upper peripheral end area, said reinforcing wall extending along said upper peripheral end area so that a peripheral double wall edge area of said lower part is formed, said reinforcing wall being curved inwards towards said side walls along at least a part of a peripheral of said reinforcing wall, a lid having an outer circumferential area arranged to rest on said peripheral double wall edge area of the lower part, first rib members extending between said side walls and said reinforcing wall, said first rib members including upper edges, and second rib members located along an outer area of said lid, said second rib members including lower edges, said first and second rib members being arranged so that when the lid is placed onto the lower part, said lower edges of the second rib members rest on said upper edges of the first rib members.

2. The container of claim 1, in which said reinforcing wall ends along at least a part of its periphery at its lower part laterally in the side walls.

3. The container of claim 1, in which an interstice is present between the side walls and the reinforcing wall which interstice is open towards the side of the lid of the container.

4. The container of claim 1, in which said reinforcing wall is curved inwards at its lower end substantially along the entire periphery of the edge area.

5. The container of claim 1, in which the lower edges of the second ribs extend obliquely relative to the upper edges of the first ribs.

6. The container of claim 1, in which the lid is curved downwards at its outer circumferential area and ends at the top in a vertical wall section, and in which the reinforcing wall extends substantially in a vertical direction, whereby the vertical wall section ends above the reinforcing wall.

7. The container of claim 6, in which an air gap is foreseen between the vertical wall section and the reinforcing wall.

8. The container of claim 1, in which the side walls end in an upper edge which contacts a peripherally extending sealing member arranged at the lid.

9. The container of claim 8, comprising handhold openings located in the edge area of the lower part and in the outer circumferential area of the lid, which, when the lid is placed onto the lower part, are located over each other and form at least one handhold, which handhold openings are located outside of the sealing member.

10. The container of claim 1, comprising elastic arresting tongues forming arresting members, which arresting tongues are located in the edge area of the lower part or in the outer circumferential area of the lid, which arresting tongues are adapted to be resiliently snapped into the lid or lower part, respectively, and whereby an actuation opening is located above each tongue in the lid or in the reinforcing wall, so that a pressure may be exerted through the actuation opening to act onto the arresting tongue.

11. The container of claim 1, in which the lid and the lower body are injection-molded products.

12. The container of claim 1, comprising at least one snapping mechanism for a locking of the lid to the lower part, which snapping mechanism includes at least a first and a second member, which members are movable at least between a closed position and a release position, and in their closed position are snapped into each other and counteract an opening of the lid, and are adapted to be operated into a release position by a deformation thereof such to allow an opening of the lid, which two members are adapted to move from their closed position into a securing position upon an acting of a sufficient opening force thereupon, in which securing position they form a form-locked interconnection counteracting such opening force.

13. The plastic container of claim 12, in which at least one first member includes a ledge and one second member includes an abutment surface and said ledge of said first member contacts in the closed position of the members said abutment surface, whereby for an operating of the members into their release position by an elastic deforming of at least one of the members said ledge is adapted to be urged away from the abutment surface in a first direction, and in which in order to operate the members into their securing position by exerting an opening force, said ledge is adapted to be urged in a different, second direction away from said abutment surface.

14. A plastic container comprising:

a lower part including a single-ply bottom and single-ply side walls and a reinforcing wall, said single-ply side walls having an upper peripheral end area, said reinforcing wall extending along said upper peripheral end area so that a peripheral double wall edge area of said lower part is formed, a lid having an outer circumferential area arranged to rest on said peripheral double wall edge area of the lower part, first rib members extending between said side walls and said reinforcing wall, said first rib members including upper edges, and second rib members located along an outer area of said lid, said second rib members including lower edges, said first and second rib members being arranged so that when the lid is placed onto the lower part, said lower edges of the second rib members rest on said upper edges of the first rib members.

15. A plastic container comprising:

a lower part including a single-ply bottom and single-ply side walls and a reinforcing wall, said single-ply side walls having an upper peripheral end area, said reinforcing wall extending along said upper peripheral end area so that a peripheral double wall edge area of said lower part is formed, wherein said reinforcing wall is curved inwards towards the side walls along at least a part of its periphery, a lid having an outer circumferential area arranged to rest on said peripheral double wall edge area of the lower part, said side walls terminating in an upper edge which contacts a peripherally extending sealing member arranged at said lid, and handhold openings located in said edge area of said lower part and in said outer circumferential area of the lid, which, when said lid is placed onto the lower part, overlap each other and form at least one handhold, said opening of said handhold being located outside said sealing member.

* * * * *